US005630543A

United States Patent [19]

Dugan

[11] Patent Number: 5,630,543

[45] Date of Patent: May 20, 1997

[54] ONE PIECE OCTAGONAL BOX

[75] Inventor: Thomas F. Dugan, Fort Wayne, Ind.

[73] Assignee: Covington Box & Packaging, Inc., Waterloo, Ind.

[21] Appl. No.: 542,692

[22] Filed: Oct. 13, 1995

[51] Int. Cl.[6] ..... B65D 5/36

[52] U.S. Cl. ..... 229/109; 229/117

[58] Field of Search ..... 229/109, 110, 229/117

[56] References Cited

U.S. PATENT DOCUMENTS

| | | | |
|---|---|---|---|
| 2,538,860 | 1/1951 | Buttery | 229/117 |
| 2,565,188 | 8/1951 | Welshenbach . | |
| 2,677,495 | 5/1954 | Buttery | 229/117 |
| 3,525,466 | 8/1970 | Robinson | 229/117 |
| 3,549,081 | 12/1970 | Nelson | 229/117 |
| 3,907,194 | 9/1975 | Davenport et al. | 229/23 BT |
| 4,114,795 | 9/1978 | Mulroy | 229/23 R |
| 4,119,266 | 10/1978 | Dempster . | |
| 4,199,098 | 4/1980 | Lopez | 229/109 |
| 4,225,078 | 9/1980 | Croley . | |
| 4,260,100 | 4/1981 | Hoffman . | |
| 4,266,716 | 5/1981 | Austin | 229/117 |
| 4,289,267 | 9/1981 | Mayea . | |
| 4,343,429 | 8/1982 | Cherry . | |
| 4,361,267 | 11/1982 | Wozniacki . | |
| 4,382,537 | 5/1983 | Muise . | |
| 4,386,729 | 6/1983 | Schmidt . | |
| 4,441,649 | 4/1984 | Nederveld . | |
| 4,502,624 | 3/1985 | Burrell | 229/109 |
| 4,549,690 | 10/1985 | Rosenburg | 229/109 |
| 4,614,298 | 9/1986 | Cherry | 229/109 |
| 4,702,408 | 10/1987 | Powlenko | 229/101 |
| 4,729,505 | 3/1988 | Remaks et al. . | |
| 4,856,705 | 8/1989 | Carr et al. | 229/109 |
| 5,531,374 | 7/1996 | Gasper | 229/109 |

FOREIGN PATENT DOCUMENTS

| | | | |
|---|---|---|---|
| 454139 | 1/1949 | Canada . | |
| 2243596 | 11/1991 | United Kingdom | 229/109 |

*Primary Examiner*—Gary E. Elkins
*Attorney, Agent, or Firm*—Randall J. Knuth

[57] ABSTRACT

The invention relates to a bulk bin box constructed from a unitary piece of cardboard folded into a substantial box shape having a top portion and bottom portion. The unitary piece of cardboard has adjacent the bottom portion at least two tabs on opposite sides of the box shape with each tab having a slot simultaneously intermeshing with the other tab. Automatic snap locking of the bottom of the box occurs on opening of the box from a folded or closed condition.

10 Claims, 2 Drawing Sheets

ONE PIECE OCTAGONAL BOX

BACKGROUND OF THE INVENTION

1. Field of the Invention

The present invention relates to cardboard containers, and, more particularly, to such containers utilized on conventional pallets.

2. Description of the Related Art

Bulk bin boxes, as known in the art, are normally boxes formed of corrugated cardboard material utilized for packing or transporting large irregular shaped objects on a pallet. These bulk bin boxes are also sometimes utilized to store granular material or even smaller stacked boxes of goods.

Prior bulk bin boxes, such as those shown in U.S. patent application Ser. No. 08/344,989, have utilized a separate bottom panel attached by glue or stitching to the side of the tube or box structure which forms the standard sides of the box. These constructions needed additional labor to assemble the boxes. Normally, bulk bin boxes do not have a closed top.

The function of the bottom of the box is not simply to contain material or goods within, but to hold the shape of the box during loading while the box sits on a pallet. The pallet on which the box sits supports both the objects within the box and the box itself.

Additionally, some prior boxes were not formed so that they could be folded to minimize space for transportation purposes prior to being loaded. Other prior bulk bin boxes utilize four sides which have the effect of concentrating the forces of a full bin toward the center of the box sides. At times these forces, depending upon the product or material held by the bulk bin, can tear or burst the box.

What is needed in the art is a foldable bulk bin box that may be placed into a folded condition prior to use and unfolded to a substantially box shape when needed to be filled with goods.

SUMMARY OF THE INVENTION

The present invention provides an octagonal bulk bin pallet box comprising a unitary piece of cardboard or corrugated material folded into a substantial box shape having a top and a bottom. A portion of the cardboard adjacent the bottom has two tabs, the tabs each having a slot on opposite sides of the box shape forming a blank. Each tab slot enmeshes simultaneously with the other tab forming the bottom of the box. A structure of box flaps permits it to be folded for transportation and when needed, opened causing the bottom to snap form into place.

The invention comprises, in one form thereof, a bulk bin box of a unitary piece of cardboard folded into a substantial box shape having a top portion and bottom portion. The unitary piece of cardboard is adjacent the bottom portion having two tabs on opposite sides of the box shape with each tab having a slot simultaneously intermeshing with the other tab.

The invention comprises, in another form thereof, a cardboard blank for forming a collapsible box that can be folded to a closed position. A corrugated sheet is utilized having a top and bottom, with the sheet having a plurality of first fold lines. The first fold lines define at least two attachment panels and plurality of separating panels, with the separating panels disposed between the attachment panels. The sheet includes a second fold line spaced apart from the bottom edge with at least two tabs attached to the attachment panels opposite the second fold line. The first fold lines intersect the second fold line. At least two of the tabs have a tab slot thereon, each tab slot able to simultaneously intermeshing with another tab, whereby together the tabs with the tab slots form the bottom of the collapsible box. Additionally, a plurality of third fold lines and cut lines extend from the second fold line to the sheet bottom forming a plurality of flaps engagable with the bottom of the collapsible box when the collapsible box is unfolded.

In one form of the invention, the first fold lines are vertically oriented on the blank and the second fold line is oriented horizontally on the blank.

An advantage of the present invention is that the box employs one-piece or unitary construction which thereby necessitates no separate pieces needed to create the foldable bulk bin box. This reduces labor costs and assembly time.

Another advantage of the present invention is that only a single seam is needed to be glued or bound to form the one-piece sheet material or blank into the shape required. Prior types of bulk bin boxes required at least three seams, one seam being the side seam forming the substantially box shaped tube portion, with the two other seams formed along the box bottom with the separately formed and die cut bottom panel.

Yet another advantage of the present invention is that the bulk bin box is foldable from an open fillable position to that of a closed, flat folded position, and vice versa. The closed folded position minimizes the volume taken up by the bulk bin box. In this fashion, the bulk bins of the present invention may be transported with a minimum volume and only opened to their full volume capacity immediately prior to loading.

A further advantage of the present invention is that the bottom panel formed by the connection of two tabs extending from the bottom of the box automatically moves in place during the unfolding of the box, thereby permitting the person unfolding the completed box to simply place the bulk bin box upon a pallet and then begin loading operations.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
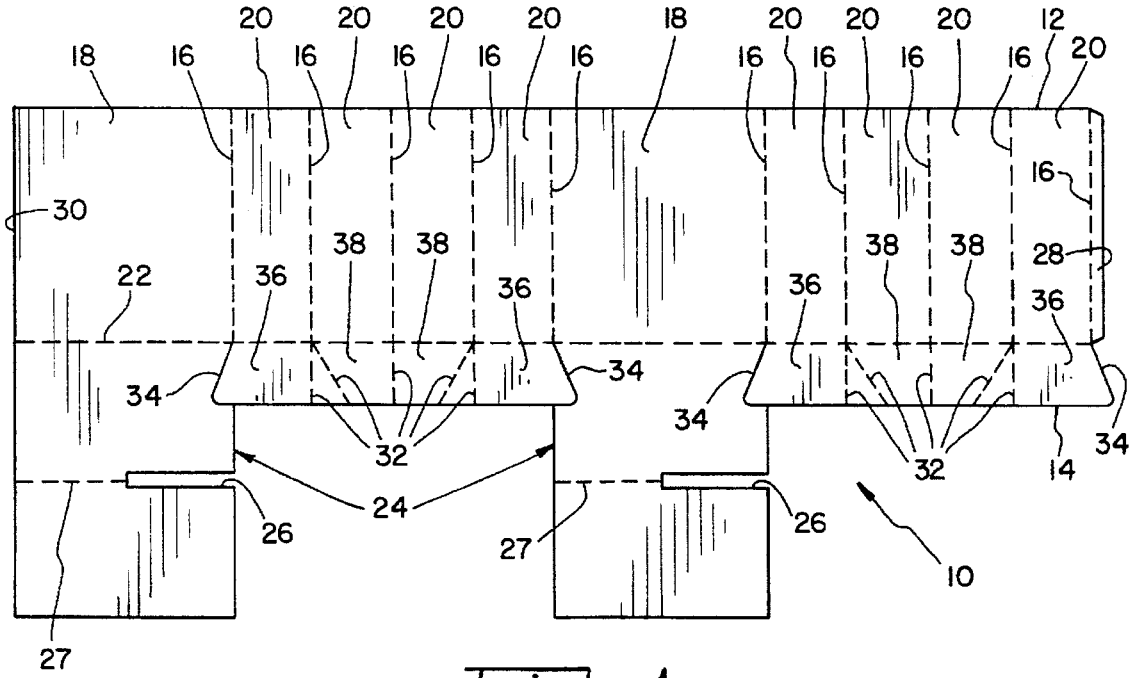
FIG. 1 is a plan view of the blank utilized in forming one embodiment of the present invention.

Referring now to the drawings, and particularly to FIG. 1, there is shown a blank 10 of sheet material according to the preferred embodiment of the invention, having the form of a die cut blank from which bulk bin box 50 of the invention is constructed. Blank 10 includes a substantially rectangular piece of sheet material, preferably that of a two-ply double weight corrugated material, although other materials and thicknesses may be utilized. This generally rectangular blank 10 includes a top edge 12 and a bottom edge 14. Blank 10 is divided by a plurality of vertical fold lines 16 that define at least two attachment panels 18 that form opposite sides of the completed box structure. Vertical fold lines 16 also define a plurality of separating panels 20 disposed between attachment panels 18.

Blank 10 includes a generally horizontal fold line 22 in a spaced relationship from bottom edge 14. At least two tabs 24 are formed integrally with blank 10, attached to attachment panels 18 opposite horizontal fold line 22.

As shown in FIG. 1, each tab 24 includes a slot 26. These slots 26, when blank 10 is assembled, simultaneously enmesh with each other to connect tabs 24 together in a locking arrangement. Together these connected tabs 24, connected by the interfitting of slots 26 with each other and the other tab 24, form the foldable bottom of the present invention. A fold line 27 extends from the end of each slot 26 to the opposite side of each respective tab 24.

Figure 6:
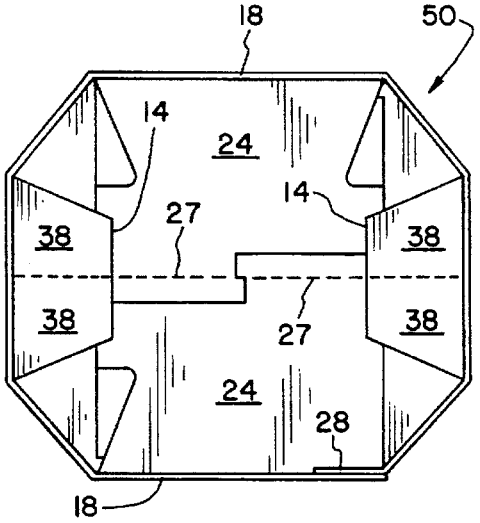
FIG. 6 is a interior bottom view of the box of FIG. 2 in the open position.

As shown in FIG. 6, along one side edge of blank 10 is a gluing panel 28 which is utilized with either glue, or other fastening means such as stitches, to attach to opposite side 30 of blank 10 to thereby form the upstanding walls of a bulk bin box 50 of the present invention.

Adjacent to horizontal fold line 22 and a bottom edge 14 are a plurality of fold lines 32 and cut lines 34. Each of these fold lines 32 and cut lines 34 extend from horizontal fold line 22 to the sheet bottom edge 14 forming a plurality of flaps. Flaps adjacent cut lines 34 form eared flaps 36 while the flap portions between fold lines 32 are identified as folding flaps 38. Cut lines 34 and fold lines 32 may be at different angles relative to horizontal fold line 22.

Figure 4:
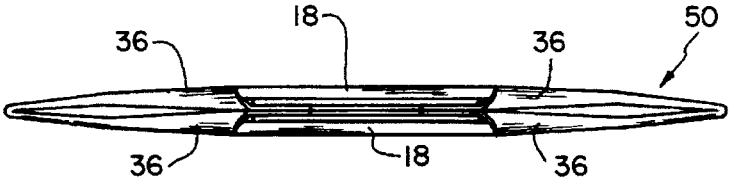
FIG. 4 is an exterior bottom view of the box of FIG. 2 shown folded to the closed position.

In this application, reference to box 50 of the present invention is normally in either the open or closed position. The open position is defined as when blank 10 is assembled in the shape of a substantially open ended box 50 such as those available for loading goods. The closed position of box 50 of the present invention is that when blank 50 is folded, after assembly, into a flat minimized volume for transport. More particularly, FIG. 4 shows the assembled blank 10 forming box 50 of the present invention in the closed position. A halfway position of the box of the present invention such that it is not fully open nor fully closed, is shown in FIGS. 3 and 5 illustrating the orientation of eared and folding flaps 36 and 38, respectively, either during the closing motion or opening motion dependent upon the initial condition of box 50.

Figure 2:
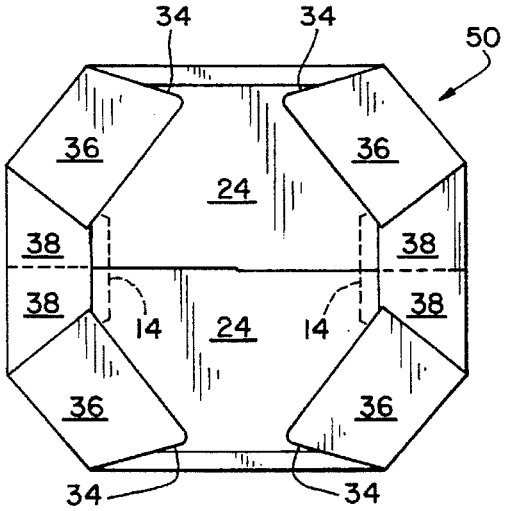
FIG. 2 is an exterior bottom view of the box of the present invention in the open position.
Figure 7:
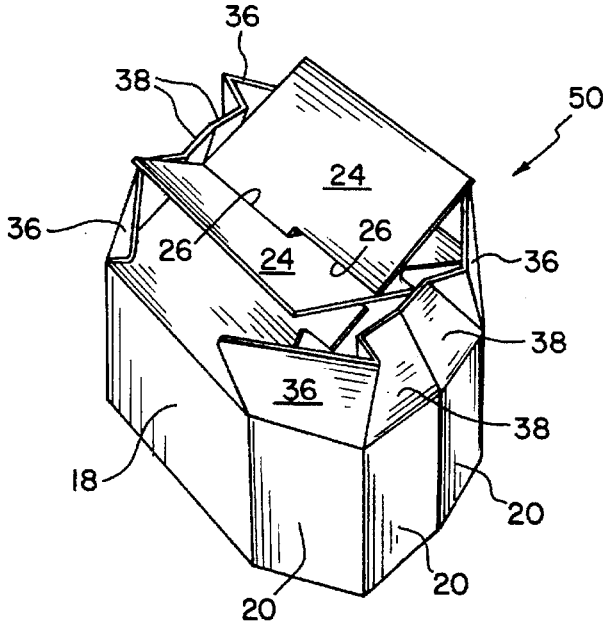
FIG. 7 is a bottom perspective view of the box of FIG. 2 at assembly time.

During assembly of bulk bin box 50, blank 10 would have previously been die cut from a sheet of material and scored and folded along the plurality of fold lines 16, 22, 27 and 32 described above. During this assembly, gluing panel 28 is attached to opposite side 30 by means of gluing, stitching, staples or the like. After gluing panel 28 has been attached to opposite side 30, box 50 will be in a substantially recognizable box shape form. Box 50 is overturned so that it is resting on top edge 12 while tabs 24 will be interlocked through the sliding of each slot 26 the opposite slot 26 on another tab 24. This interconnection forms the bottom panel of box 50 without the necessity for additional gluing or attachment (FIG. 7). At this same time, eared flaps 36 and folding flaps 38 are oriented such that bottom edges 14 of folding flaps 38 are pushed toward the interior of box 50 shown particularly in FIG. 2, so that from an exterior view, bottom edges 14 of folding flaps 38 are oriented into the interior of the box. This arrangement creates a locking arrangement with the bottom of box 50 formed by tabs 24 and folding flaps 38. FIG. 6 shows the interior of the assembled bulk bin box of the present invention with the folding flaps 38 having their bottom edge 14 located along the interior of the box. Such structure permits box 50, when moved to the closed position as shown in FIG. 4, to automatically fold tabs 24 along slot fold line 27 to cause all areas of blank 10 located below horizontal fold line 22 to be disposed within the interior of box 50.

Figure 3:
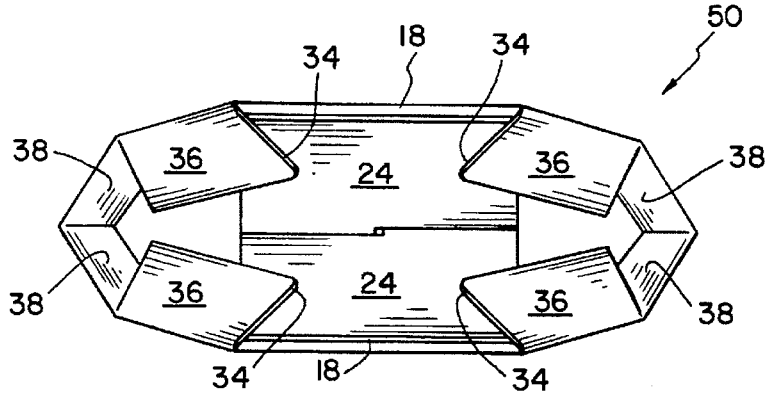
FIG. 3 is an exterior view of the box of FIG. 2 in a halfway position.
Figure 5:
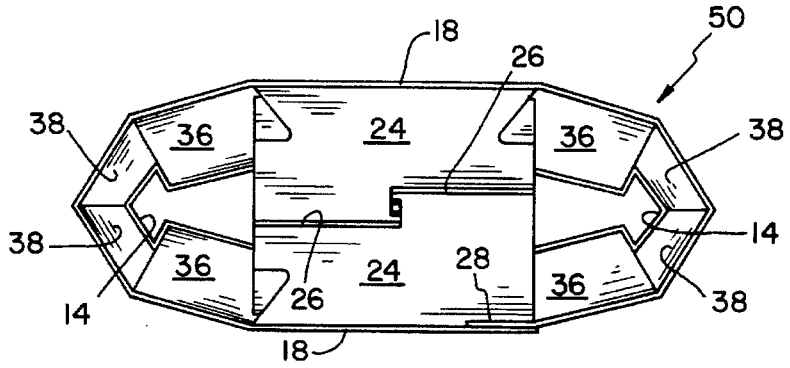
FIG. 5 is an interior bottom view of the box of FIG. 2 shown in the halfway position.

FIG. 3 and FIG. 5 show both an exterior and interior bottom view of the box of the present invention in a halfway folded position. As is evident, flaps 38 are visible from the exterior view, (FIG. 3) while from the interior view (FIG. 5) the bottom edge portion 14 of folding flaps 38 have moved, relative to FIG. 5, out of the page toward the viewer.

In operation, the present invention is first assembled from blank 10 as described above and collapsed at the closed position as shown in FIG. 4 for transportation. Upon arriving at a final destination or loading point, the operator unfolds the box by displacing attachment panels 18 from one another thereby increasing the volume of box 50. At this time, because of the orientation of the eared flaps 36 and particularly, interior displacement of folding flaps 38, folded tabs 24 are automatically unfolded into a position to be substantially planar, though still simultaneously interlocked. This structure of tabs 24, eared flaps 36 and folding flaps 36, automatically forms the bottom of box 50 of the present invention. The operator then rotates box 50 to place the bottom formed by tabs 24 onto a pallet to prepare for loading the box created.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A bulk bin box, comprising:

a unitary piece of cardboard folded into an octagonal box having a top portion and bottom portion, said unitary piece of cardboard adjacent said bottom portion having two tabs on opposite sides of said box shape with each said tab having a slot, each tab slot simultaneously and continuously intermeshing with the other tab whereby no action other than opening said box is necessary to erect the box.

2. The bulk bin box of claim 1 in which said single piece of cardboard is formable into a closed position and an open position.

3. The bulk bin box of claim 2 in which said unitary piece of cardboard includes a plurality of flaps arranged on said bottom to engage said tabs in both said closed position and said open position.

4. The bulk bin box of claim 1 in which said piece of cardboard has a plurality of flaps arranged on said bottom to engage said tabs.

5. A cardboard blank for forming a collapsible box that can be folded to a closed position, comprising:

a corrugated sheet having a top and bottom, said sheet having a plurality of first fold lines, said first fold lines defining at least two attachment panels and plurality of separating panels, said separating panels disposed between said attachment panels;

said sheet having a second fold line spaced apart from said bottom, said sheet having at least two tabs attached to said said second fold line, said first fold lines intersecting said second fold line;

at least two of said tabs having a tab slot thereon, each tab slot able to simultaneously and continuously intermesh with another said tab, whereby together said tabs with said tab slots form the bottom of the collapsible box;

and a plurality of third fold lines and cut lines extending from said second fold line to said sheet bottom forming a plurality of flaps, said flaps engagable with said bottom of the corrugated sheet when the collapsible box is unfolded to an erect open position.

6. The blank of claim 5 in which said cut lines are disposed at an angle to said first fold lines.

7. The blank of claim 5 in which said sheet has equal numbers of said tabs and said attachment panels.

8. The blank of claim 5 in which said flaps interlock with said tabs when the box is unfolded to an erect open position.

9. The blank of claim 8 in which at least two of said third fold lines are disposed at an angle to said first fold lines.

10. The blank of claim 8 in which said first fold lines are vertically oriented on said blank and said second fold line is oriented horizontally on said blank.

* * * * *